US005941290A

United States Patent [19]

Vaughn, Jr.

[11] Patent Number: 5,941,290

[45] Date of Patent: Aug. 24, 1999

[54] CLEANING SYSTEM FOR INDUSTRIAL USES

[75] Inventor: Clifford Elmer Vaughn, Jr., Rock Hill, S.C.

[73] Assignee: Diversey Lever, Inc., Plymouth, Mich.

[21] Appl. No.: 09/026,197

[22] Filed: Feb. 19, 1998

[51] Int. Cl.[6] ..... B65B 1/04

[52] U.S. Cl. ..... 141/90; 141/85; 141/89; 141/91; 134/144; 134/152; 134/153; 134/170

[58] Field of Search ..... 141/11, 85, 89–92; 134/144, 152, 153, 170

[56] References Cited

U.S. PATENT DOCUMENTS 4,207,932 6/1980 Gilmour ..... 141/90
4,452,263 6/1984 McClure ..... 134/152
4,989,392 2/1991 Lindgren et al. ..... 134/14
5,167,720 12/1992 Diamond et al. ..... 134/144
5,458,166 10/1995 Kronseder ..... 141/91

*Primary Examiner*—Henry J. Recla
*Assistant Examiner*—Timothy L. Maust

[57] ABSTRACT

An apparatus and a system for cleaning or sanitizing industrial filling equipment is described. The apparatus is a movable arm spray manifold which is used to position a spray manifold below a filling valve of a filling machine and a clean interior portion of the filling station. The system may couple the movable arm spray manifold with one or more stationary arm spray manifolds to provide a cleaning system for the filling station. A method of using both the apparatus and filling system of the invention is also described

20 Claims, 9 Drawing Sheets

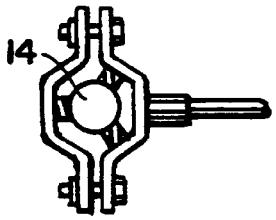
FIG.4
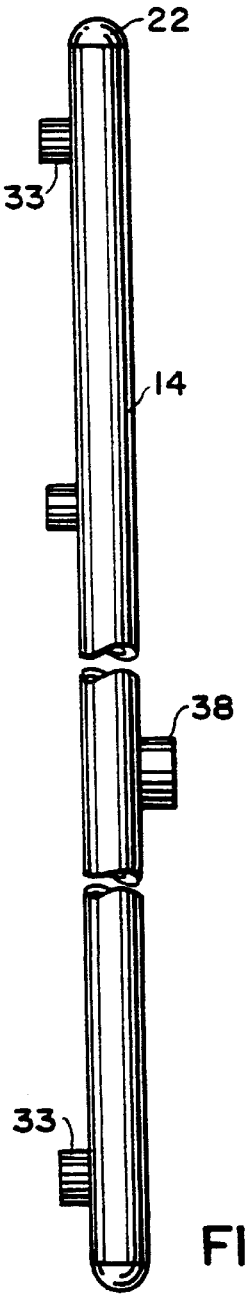
FIG.6
FIG.5
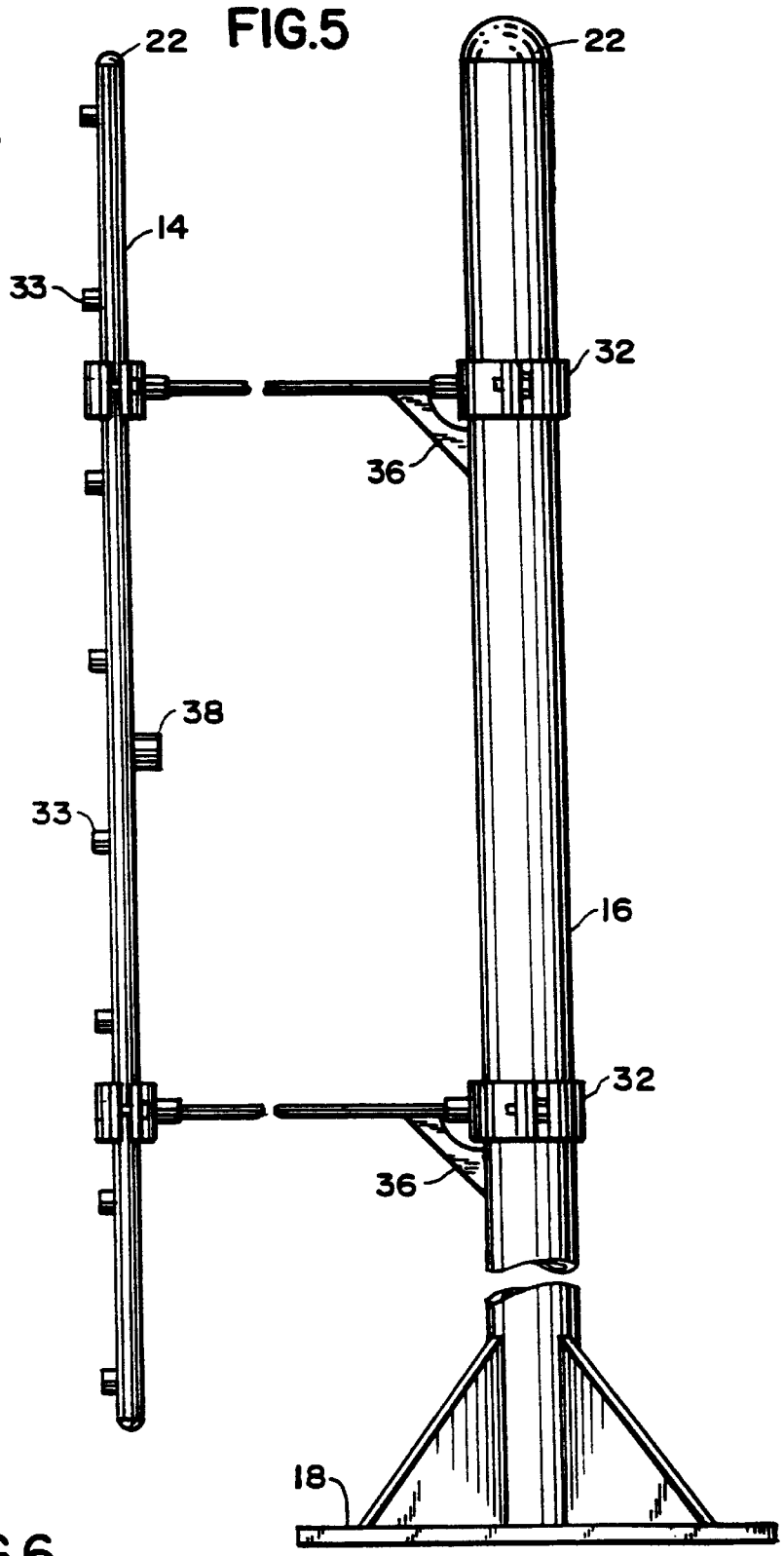

18

18

CLEANING SYSTEM FOR INDUSTRIAL USES

FIELD OF THE INVENTION

This invention relates to a system for cleaning or sanitizing industrial filling equipment. The system has a movable arm spray manifold means coupled with at least one stationary arm spray manifold means.

BACKGROUND OF THE INVENTION

Industrial equipment for filling containers such as bottles or cans in beverage or brewery plants contain a difficult to clean filling area. Generally a filling valve is positioned above the container to empty contents from a rotating filling source. After filling, the container moves from the filling station towards a crowning or capper area and the next container to be filled is positioned under the filler valve to receive the contents from the machine. Over time, the filling station may become soiled with the filling contents and potentially broken glass or metal filings may also accumulate in the filling area.

In the past, a stationary arm spray manifold attached to a vertical stanchion was used to spray detergent or sanitizing agents onto the filling station to clean or sanitize it. The problem with the stationary arm spray manifolds is that the direction of detergent or sanitizing spray could not be easily changed to clean the interior portion of the filling valve directly above the containers to be filled. Since cleaning the reverse side of the valve is virtually impossible, to clean this portion, historically, the production line was stopped and the area was manually cleaned.

The present invention addresses the problem of cleaning the entire filling station automatically. In particular, detergent or sanitizing spray is directed to all points of the filling station without the need to manually clean beneath or behind the filling valve of the station.

It is thus an object of the present invention to provide a cleaning apparatus for cleaning or sanitizing the filling station, in particular, the filling valve of the filling station of an industrial filling machine. The apparatus has a movable arm spray manifold which may be mounted or coupled with a housing and is used to position the spray arm below the filling valve to direct a cleaning or sanitizing spray upward toward an interior area and reverse side of the filling valve. The movable manifold is then used to move the spray arm away from the filling station so that the filling production can resume with little interruption.

In a preferred embodiment, the apparatus is coupled with at least one stationary arm spray manifold to form a cleaning or sanitizing system which directs a sanitizing or cleaning spray onto both exterior and interior portions of the filling station.

A method for using the apparatus alone or in the cleaning system is also described.

BRIEF DESCRIPTION OF THE DRAWINGS

FIG. 4 is a cross sectional view of the mounting clamp shown in FIG. 2.

FIG. 5 is a cross sectional view of the system shown in FIG. 2.

FIG. 6 is a side elevation view of the spray arms of the system.

DETAILED DESCRIPTION OF PREFERRED EMBODIMENTS

The present invention pertains to a cleaning apparatus and system for cleaning or sanitizing industrial filling equipment.

Figure 1:
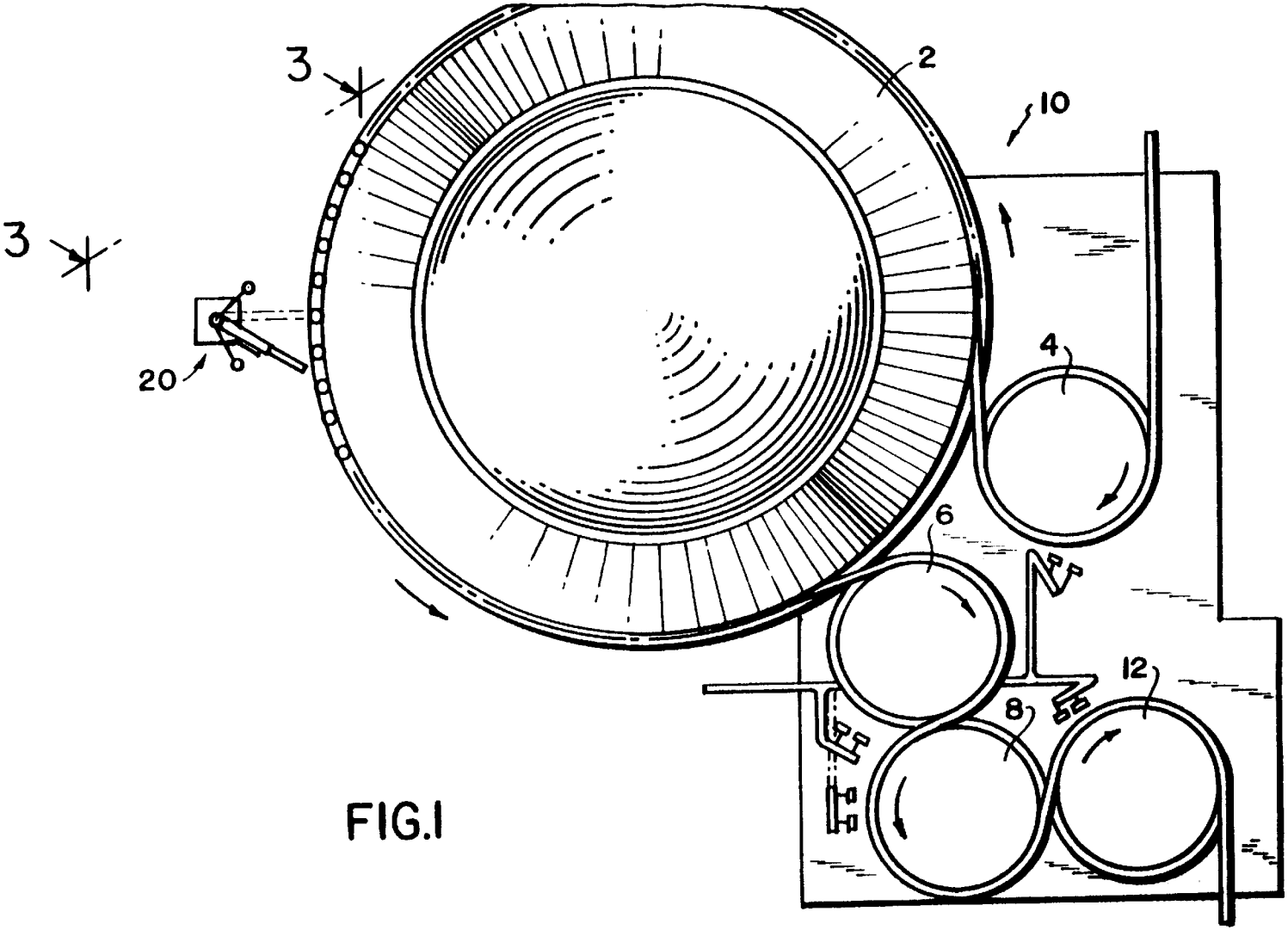
FIG. 1 is schematic top plan of a beverage filling production line including the movable apparatus of the invention.

Filling equipment used in industrial or institutional settings fill containers with liquid or semi-liquid materials. In particular, such equipment is generally found in beverage or brewery plants. A conventional filling equipment 10 used in a beverage or brewery plant is schematically illustrated in FIG. 1.

In such a system, the containers, generally bottles or cans to be filled travel on a continuous track from an infeed station 4 around a filler or star wheel 2 and are filled with the liquid or semi-liquid material from one or more filler valves. Once filled the containers continue on the track to a discharge star 6 and then to a capper or seamer station 8 tog receive closures. The closure may be seamed in a seamer area. Once the container is sealed, the track passes out of the closure area to a capper or seamer discharge star wheel 12.

Figure 3:
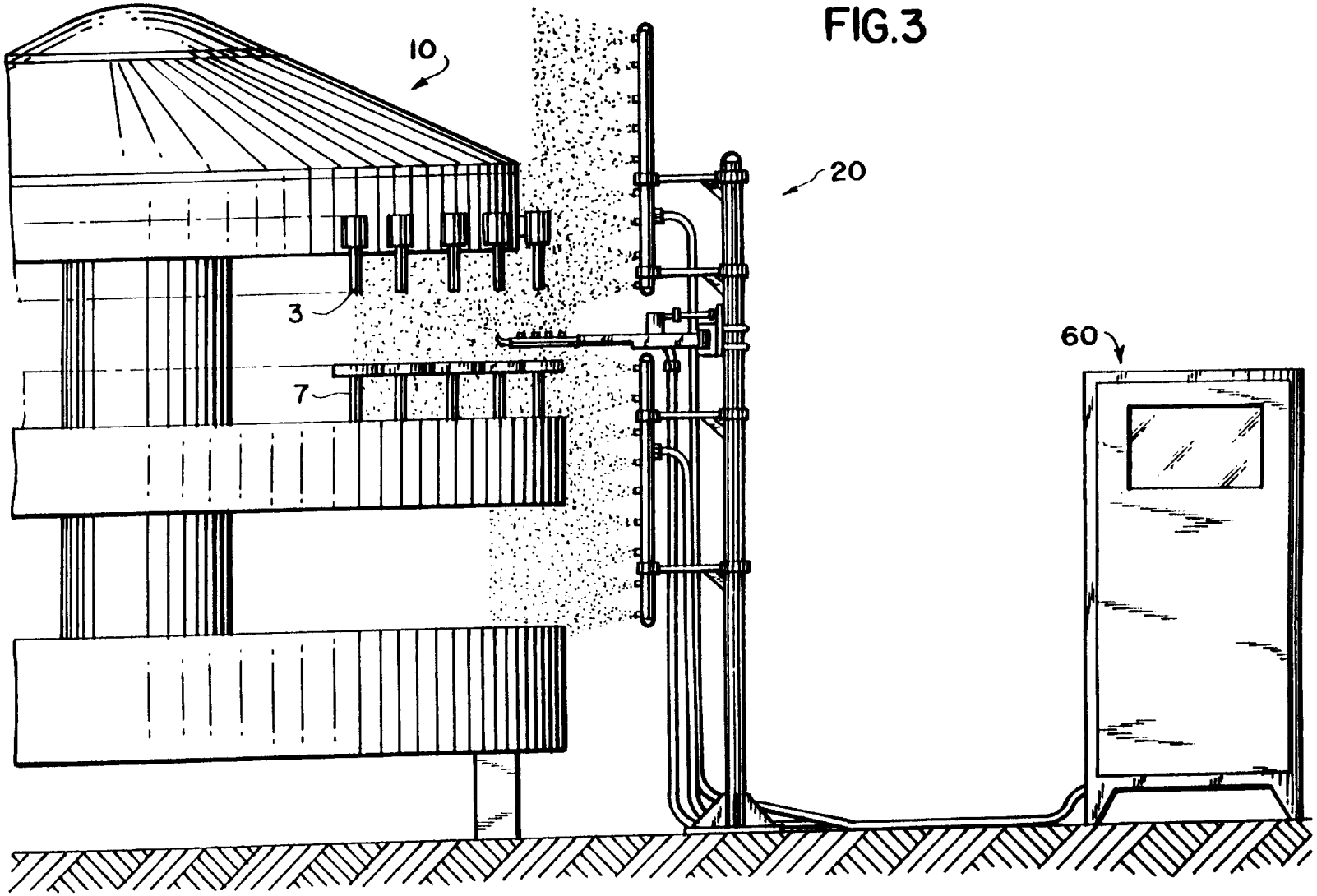
FIG. 3 is a cross sectional view of the filling station and cleaning system of FIG. 1.

As illustrated in FIG. 3, a filler valve 3 is generally positioned above rests 7 on the track so the container can be positioned to receive its contents. As the containers travel on the continuous track, the contents to be filled may spill and overflow or the containers may break or tip. Over time, the filling station becomes soiled with the contents to be filled.

Figure 2:
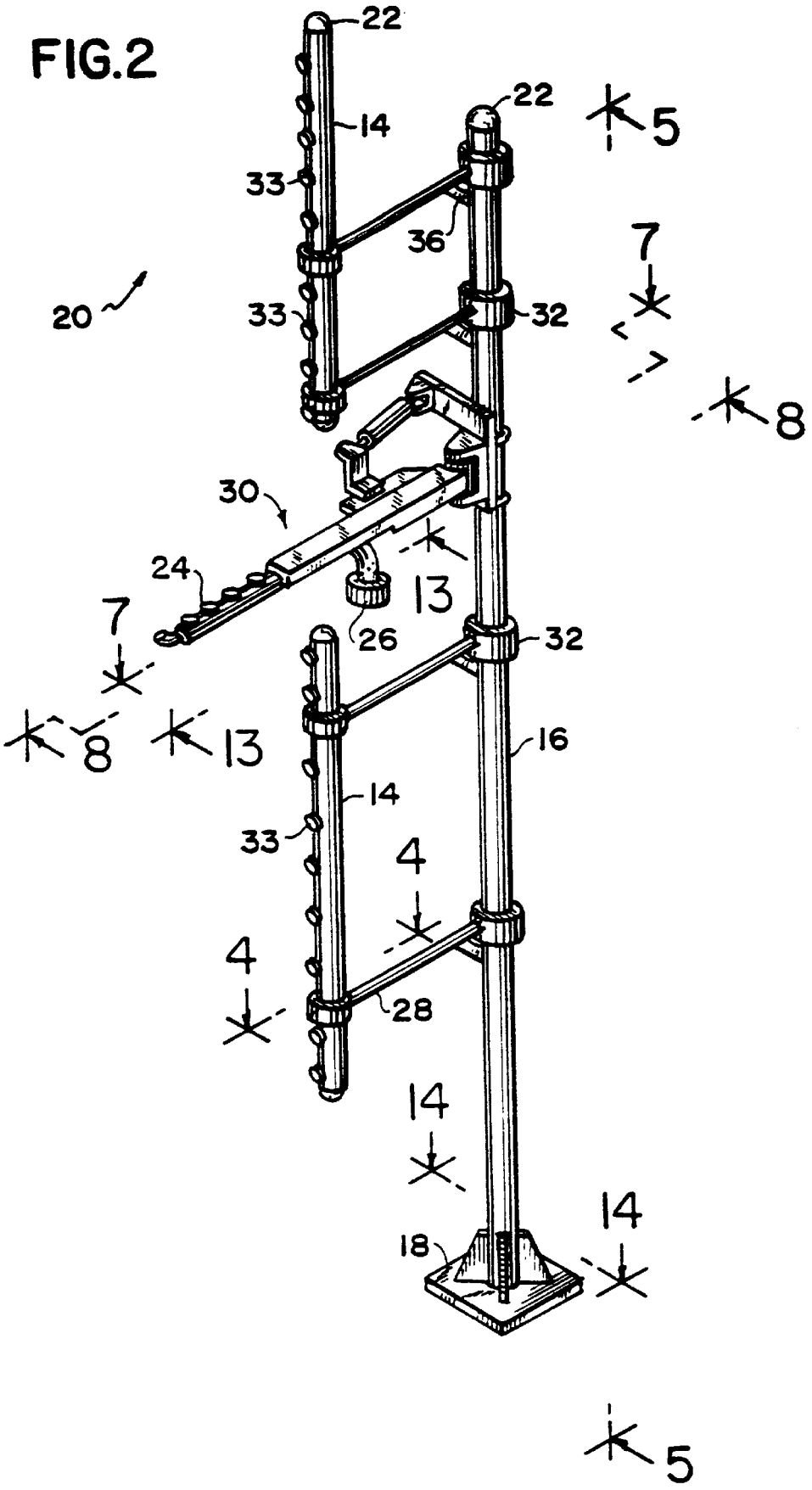
FIG. 2 is an overview of the system of the invention including the movable arm spray apparatus coupled with two stationary spray arm manifolds.

Cleaning the interior of the filler valve or valve 3 and the surrounding area has proven difficult in the prior art. To address this problem and as illustrated in FIG. 2, a movable spray arm assembly 30 is provided. The spray arm assembly 30 is mounted onto a vertical stanchion 16 preferably by means of a vertical pipe clamp 54, most preferably having a proximity sensor. A movable arm 31 of the assembly 30 contains a plurality of nozzles 24 through which detergent active or a sanitizing agent may be sprayed.

To clean the filler valve or valves 3, the movable spray arm may be positioned with the nozzles 24 directed upward toward the filler valve 3 to clean and sanitize the valve.

It should be understood that the spray arm assembly 30 may be positioned in the filling area by any conventional means known in the art. In a preferred embodiment illustrated in FIGS. 7–11 the spray arm 31 is extended by a pneumatic air assembly wherein the arm 31 is connected via a cylinder 40 and ultimately connected to the vertical stanchion via a vertical pipe clamp having a proximity sensor 54 and swing bracket 46. The sensor uses a magnetic field as a safety feature to prevent the arm 31 from swinging into a loading filler valve 3. By means of the pneumatic air assembly a swing arm 50 positions the movable spray arm 31 to place the nozzles 24 directly under the filler valve 3.

Figure 7:
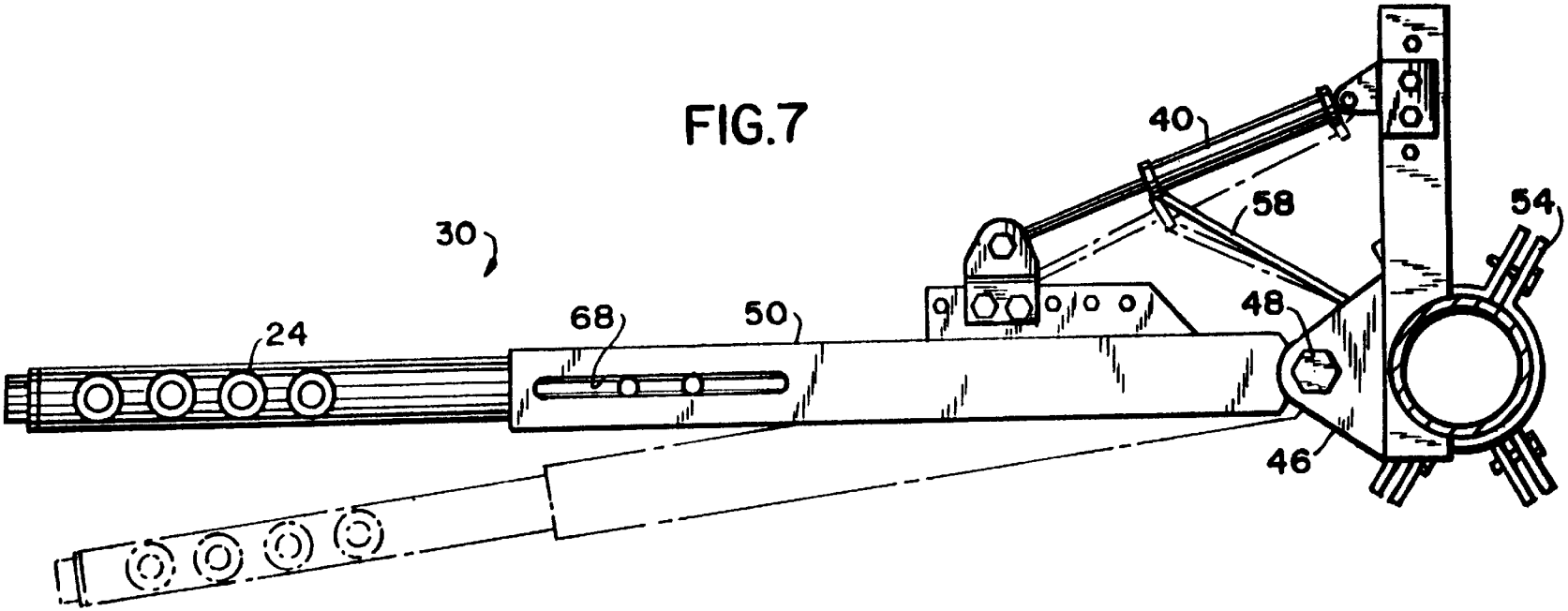
FIG. 7 is a top view of the movable spray arm manifold of the invention in two possible positions.

In addition to a horizontal positioning the swing arm 50 positions the movable spray arm 31 telescopically by providing a slide means 68, as illustrated in FIG. 7. The slide means 68 contains a slide groove 69 (see FIG. 11) which enables the spray arm 31 to move away or toward a vertical stanchion 16 when the pneumatic air cylinder 40 is activated. Any means of activating the pneumatic air assembly known in the art is suitable for the invention.

Figure 15:
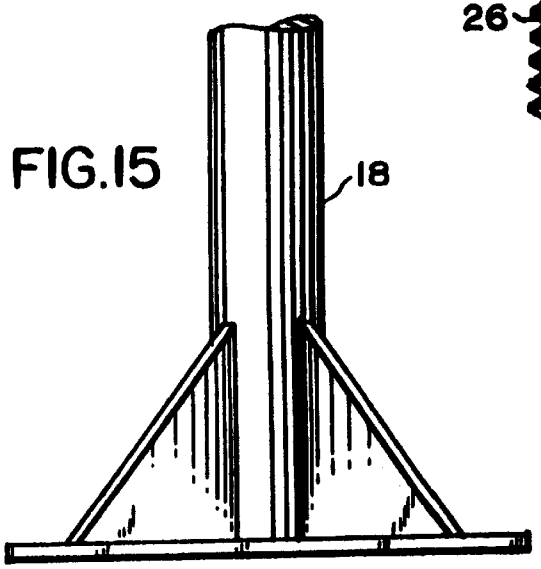
FIG. 15 is a side view of the stanchion base.
Figure 14:
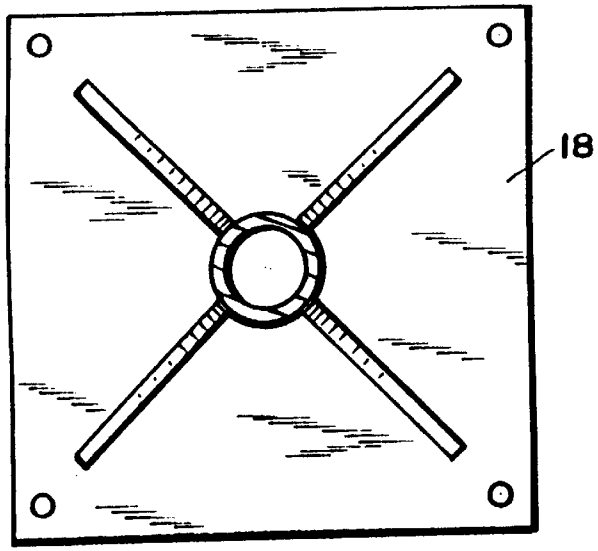
FIG. 14 is a cross sectional view of the stanchion base.

The vertical stanchion 16 is stabilized by a base plate 18 as particularly shown in FIGS. 14 and 15.

Figure 8:
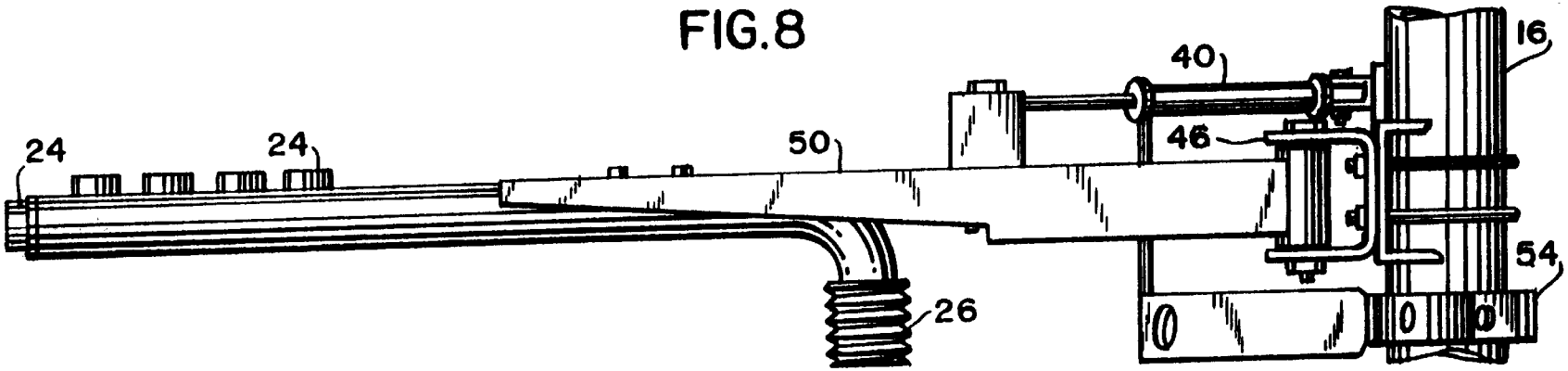
FIG. 8 is a side elevational view of the movable arm including a water coupling
Figure 9:
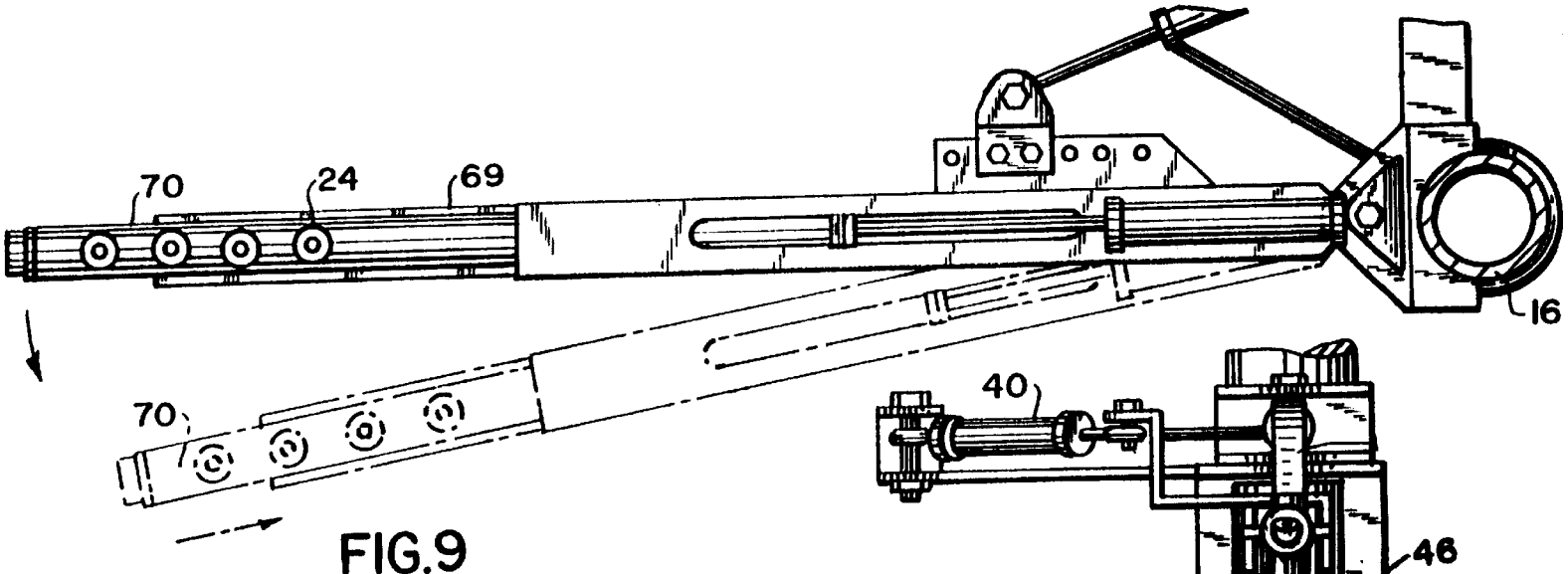
FIG. 9 is a top view of the movable spray arm indicating a second means of extending the arm.
Figure 10:
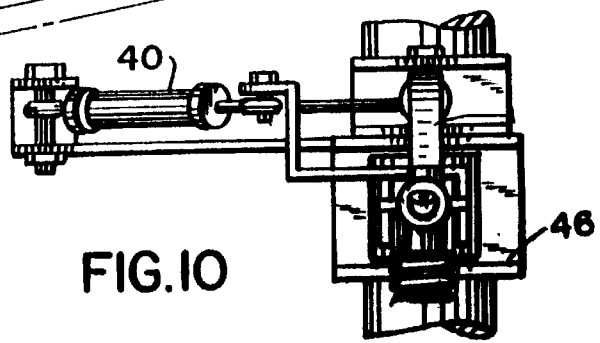
FIG. 10 is a front view of the v-bolt of FIGS. 8–9.
Figure 11:
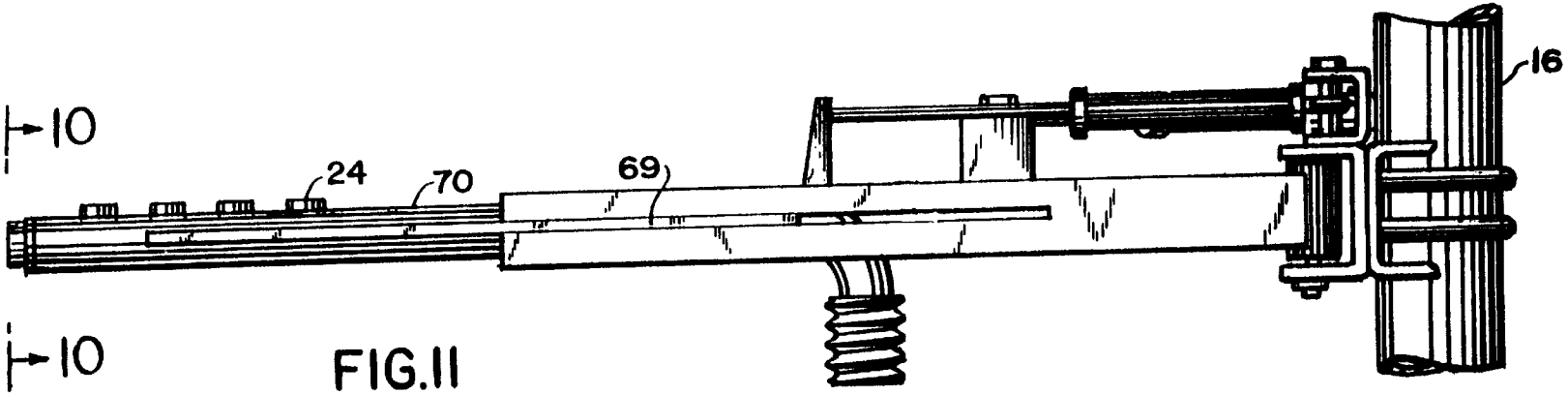
FIG. 11 is a side elevational view illustrating a slide means for extending the movable arm.
Figure 12:
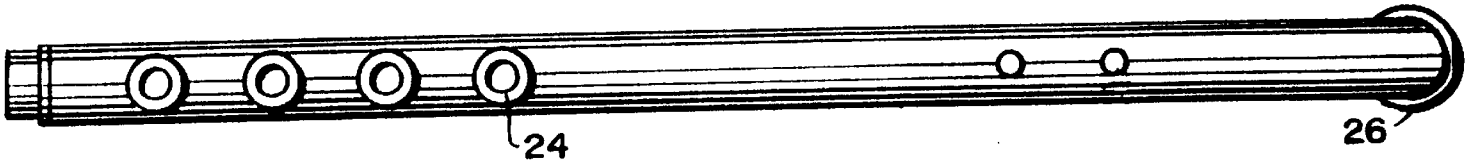
FIG. 12 is a top view of the spray arm manifold.
Figure 13:
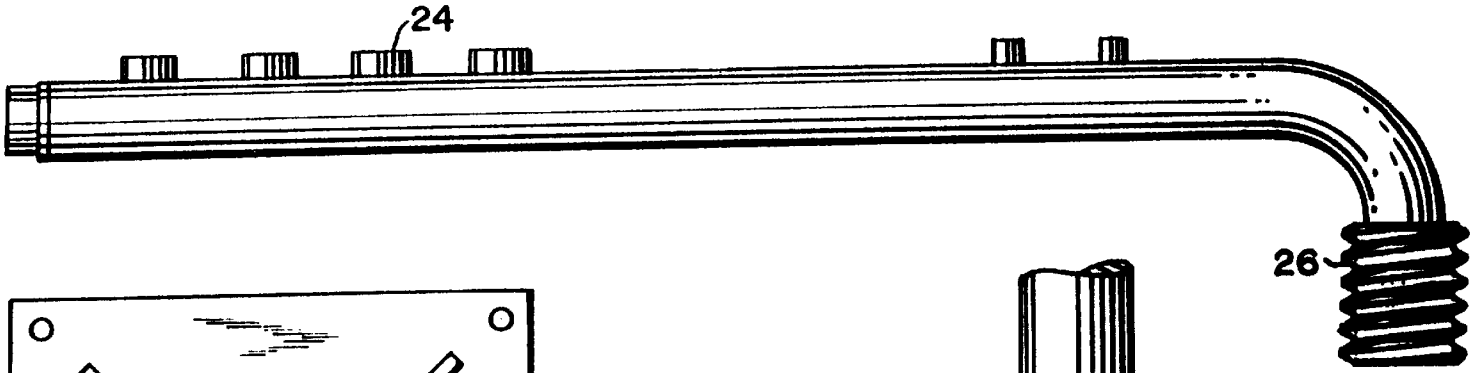
FIG. 13 is a side view of the spray arm manifold.

A coupling 26 is connected to a curved portion of the swing arm 50 as illustrated in FIGS. 8 and 11. The coupling connects to a detergent or sanitizing composition source whose proportions and pressure are controlled by any conventional means known in the art such as a programmable logic controller (PLC), housed in a control panel 60 and connected to the spray arm assembly 30 by conventional means.

Preferably, the detergent is supplied in a foam whose viscosity is determined by the ratio of water, air and detergent active combined as programmed in the control panel 60. Preferably, the detergent liquid contains from about 0.8 to about 4% detergent active and the balance being water. The detergent liquid is expanded as a foam with air at a ratio of preferably about 8 to 1 air to detergent. This optimum detergent foam provides about 20 gallons per minute of detergent active to clean the filling station.

The height of the detergent or sanitizing spray is determined by the position of the nozzles 24 relative to the filler valve or valves 3 in combination with applied pressure programmed in the control panel 60. Preferably, the foam spray is sprayed from the spray arm 31 at a pressure of about 30 to 80 lbs. per minute, preferably about 60 lbs. per minute.

Any conventional sanitizing active known in the art may be used in the invention to provide the sanitizing agent.

Figure 16:
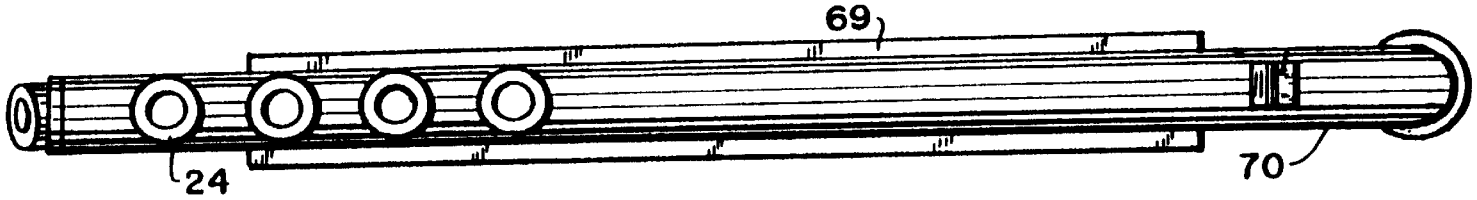
FIG. 16 is a top view of the slide member illustrated in FIG. 9.
Figure 17:
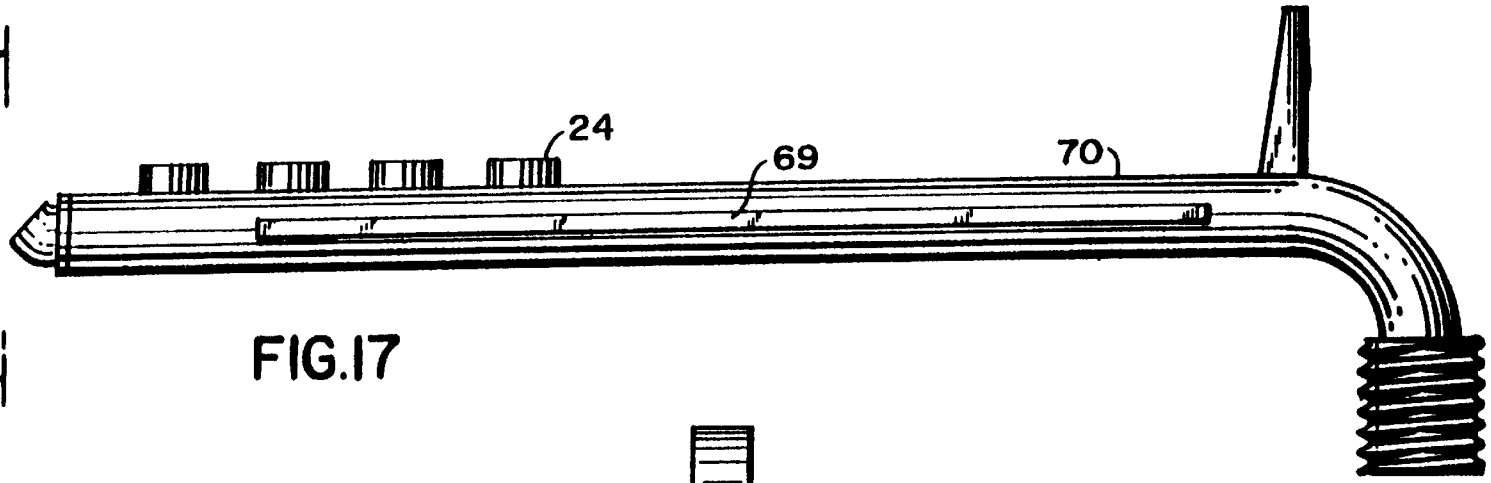
FIG. 17 is a side view of the slide member of the movable spray arm.
Figure 18:
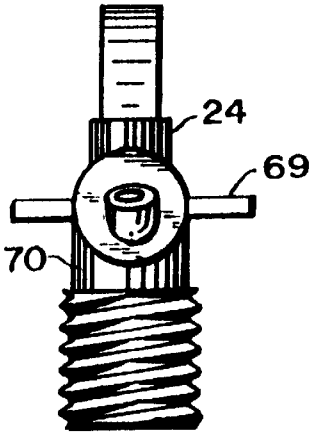
FIG. 18 is a front view of the movable spray arm.

In another preferred embodiment of the inventive apparatus, a linear motion device 70, preferably an electrical version of the pneumatic cylinder 40 is used to position the spray arm 31 as shown in FIGS. 16–18.

Figure 19:
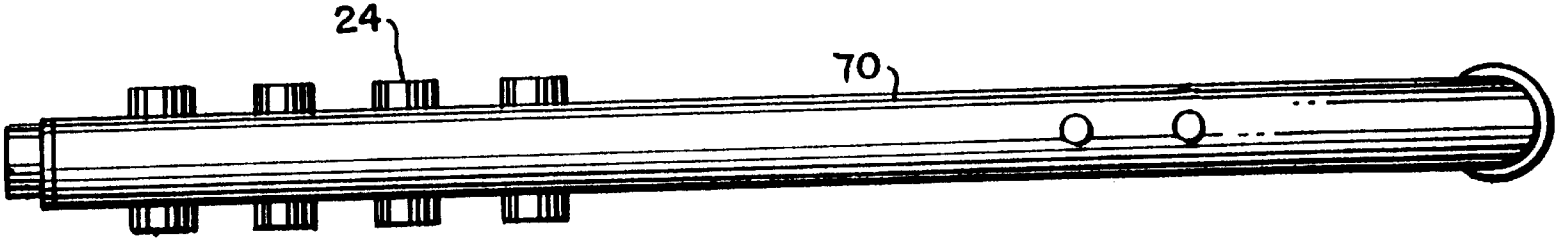
FIG. 19 is a side view of the movable spray arm having both lateral and top positioned nozzles.
Figure 20:
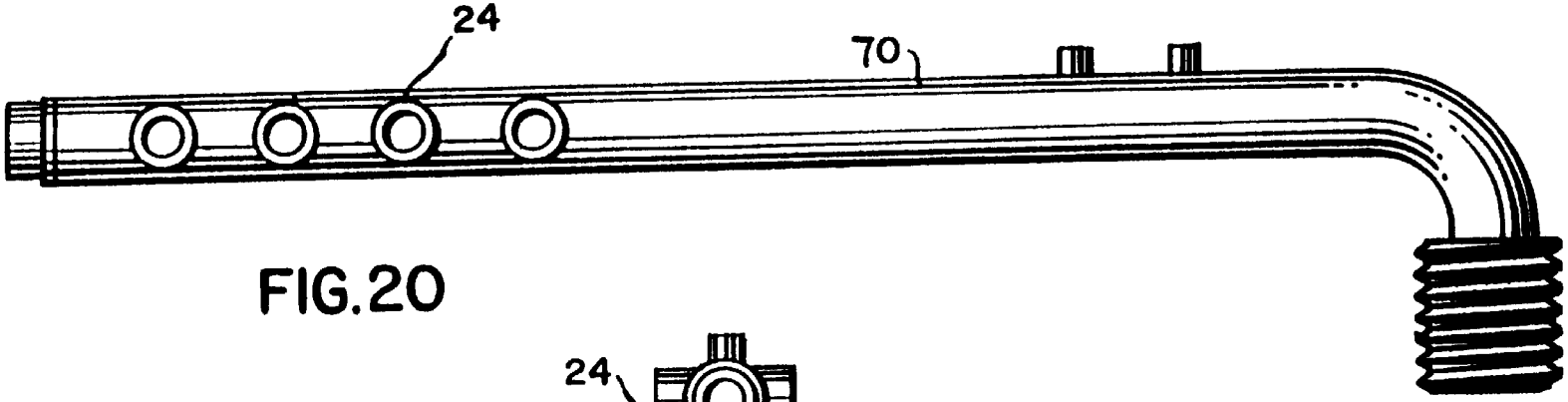
FIG. 20 is a side view of the movable spray arm of FIG. 19.
Figure 21:
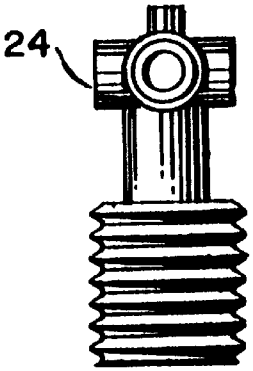
FIG. 21 is a front view of the movable spray arm of FIG. 20.

In still another preferred embodiment the nozzles 24 of the spray arm 31 are located laterally along the axis of the spray arm 31 to provide a larger clearance space between the rests 7 on the track and the opening of the filler valves 3 as illustrated in FIGS. 19–20.

Another preferred embodiment of the apparatus is a robotic arm which may be used to position the nozzles as known in the art to spray the detergent or sanitizing agent on the filler valves.

It should be understood that any means known in the art to move the movable arm spray into position under the filler valve is within the scope of the invention.

A system 20 of combining the movable spray arm 31 with at least one stationary spray manifold arm 14 to provide a cleaning or sanitizing system of both the interior or exterior of the filling station is also within the scope of the invention. In a preferable embodiment as shown in FIG. 2 and 3, the movable spray arm 31 is coupled with two stationary spray arms 14 to direct detergent or sanitizing active to substantially all of the filling station areas for cleaning or sanitizing. The stationary spray arms 14 are preferably attached to the vertical stanchion 16 via a brace 36 and stanchion clamps 32 and the detergent or sanitizing agent is connected to the arms 14 via a water inlet 38. Arm nozzles 33 provide a means of spraying the agents onto the filling star 2 of the filling station. Caps 22 are preferably used to cap the arms 14 to prevent liquid spillage.

I claim:

1. An apparatus for cleaning or sanitizing industrial filling equipment comprising: movable arm spray manifold means mounted to a housing and used for positioning a spray manifold below a filling valve of a filling machine to direct a cleaning or sanitizing spray onto an interior area of the filling valve and to subsequently move the spray manifold away from the filling valve after cleaning or sanitizing.

2. An apparatus according to claim 1, wherein the movable arm spray manifold means is a pneumatic air cylinder.

3. An apparatus according to claim 1, wherein the movable arm spray manifold means is a linear motion device.

4. An apparatus according to claim 1, wherein the movable arm spray manifold means is a robotic arm.

5. An apparatus according to claim 1, wherein the movable arm spray manifold means contains a plurality of nozzles.

6. An apparatus according to claim 1, wherein the cleaning spray contains from about 0.8 to about 4% detergent.

7. An apparatus according to claim 1, wherein the movable arm spray manifold means sprays the cleaning or sanitizing spray in a range of about 30 lbs. to about 80 lbs.

8. A system for cleaning or sanitizing industrial filling equipment comprising:

(a) movable arm spray manifold means mounted to a housing and used for positioning a spray manifold below a filling valve of a filling machine to direct a cleaning or sanitizing spray onto an interior area of the filling valve and to subsequently move the spray manifold away from the filling valve after cleaning or sanitizing; and (b) at least one stationary arm spray manifold means associated with the movable arm spray manifold means and coupled to the housing, the stationary arm spray manifold means used for directing a cleaning or sanitizing spray onto an exterior portion of the filling valve.

9. A system according to claim 8, wherein the movable arm spray manifold means is a pneumatic air cylinder.

10. A system according to claim 8, wherein the movable arm spray manifold means is a linear motion device.

11. A system according to claim 8, wherein the movable arm spray manifold means is a robotic arm.

12. A system according to claim 8, wherein the movable arm spray manifold means contains a plurality of nozzles.

13. A system according to claim 8, wherein the cleaning spray contains from about 0.8 to about 4% detergent.

14. A system according to claim 8, wherein the movable arm spray manifold means sprays the cleaning or sanitizing spray in a range of about 30 lbs. to about 80 lbs.

15. A system according to claim 8, wherein the filling equipment is used for filling a beverage container.

16. A system according to claim 8, wherein at least two stationary arm spray manifold means are used.

17. A method for cleaning or sanitizing industrial filling equipment comprising the steps of:

(a) selecting a cleaning or sanitizing system comprising:

(i) movable arm spray manifold means mounted to a housing and used for positioning a spray manifold below a filling valve of a filling machine to direct a cleaning or sanitizing spray onto an interior area of the filling valve and to subsequently move the spray manifold away from the filling valve after cleaning or sanitizing, and (ii) at least one stationary arm spray manifold means associated with the movable arm spray manifold means and coupled to the housing, the stationary arm spray manifold means used for directing a cleaning or sanitizing spray onto an exterior portion of the filling valve; and (b) substantially cleaning or sanitizing the filling machine.

18. A method according to claim 17, wherein the movable arm spray manifold means is a pneumatic air cylinder.

19. A method according to claim 17, wherein the movable arm spray manifold means is a linear motion device.

20. A method according to claim 17, wherein the movable arm spray manifold means is a robotic arm.

* * * * *